US012104876B1

(12) United States Patent
Huang

(10) Patent No.: US 12,104,876 B1
(45) Date of Patent: Oct. 1, 2024

(54) DEFORMABLE ARCHERY TOY

(71) Applicant: Chumin Huang, Shantou (CN)

(72) Inventor: Chumin Huang, Shantou (CN)

( * ) Notice: Subject to any disclaimer, the term of this patent is extended or adjusted under 35 U.S.C. 154(b) by 0 days.

(21) Appl. No.: 18/381,594

(22) Filed: Oct. 18, 2023

(51) Int. Cl.
*F41B 3/02* (2006.01)
*F41B 5/00* (2006.01)

(52) U.S. Cl.
CPC ..... *F41B 5/0052* (2013.01); *F41B 3/02* (2013.01)

(58) Field of Classification Search
CPC .. F41B 3/02; F41B 5/00; F41B 5/0026; F41B 5/0031; F41B 5/0052; F41B 5/14; F41B 5/1403
USPC ..... 124/20.1, 23.1, 88
See application file for complete search history.

(56) References Cited

U.S. PATENT DOCUMENTS 213,851 A * 4/1879 Streeter ..... F41B 5/00 124/24.1
217,741 A * 7/1879 Morton ..... F41B 5/0026 124/23.1
695,596 A * 3/1902 Bayard ..... F41B 5/1411 124/24.1
2,001,470 A * 5/1935 Nyvall ..... F41B 5/143 124/91
2,228,823 A * 1/1941 Helm ..... F41B 5/0026 124/23.1
2,426,283 A * 8/1947 Pearson ..... F41B 5/0026 403/310
2,457,793 A * 12/1948 Bear ..... F41B 5/0026 124/23.1
2,514,638 A * 7/1950 Grenier ..... F41B 5/0026 124/23.1
3,156,230 A * 11/1964 Groves ..... F41B 5/0026 403/362
3,527,196 A * 9/1970 Karbo ..... F41B 5/0026 124/24.1
3,612,028 A * 10/1971 Karbo ..... F41B 5/0026 124/88
3,738,348 A * 6/1973 Karbo ..... F41B 5/0026 273/DIG. 7
3,957,027 A * 5/1976 Drake ..... F41B 5/0026 124/88
4,076,005 A * 2/1978 Hill ..... F41B 5/10 124/90
4,989,577 A * 2/1991 Bixby ..... F41B 5/0031 124/900

(Continued)

*Primary Examiner* — Alexander R Niconovich
(74) *Attorney, Agent, or Firm* — Ying-Ting Chen; Law Office of Michael Chen

(57) ABSTRACT

A deformable archery toy may include an annular rotating arm, a rotating shaft sleeve, an unfolding arm body A, an unfolding arm body B and a connecting arm body, wherein one end of the annular rotating arm is rotatably connected with the grip connecting arm, one end of the grip connecting arm far away from the annular rotating arm is fixedly connected with the unfolding arm A, one end of the unfolding arm A far away from the grip connecting arm is clamped with the string connecting sleeve block A, one end of the annular rotating arm far away from the grip connecting arm is fixedly connected with the unfolding arm B. In this invention, the whole archery toy could be effectively folded, the archery toy could be changed from the archery bow to the slingshot, so that the dual-purpose function could be effectively achieved.

6 Claims, 4 Drawing Sheets

(56) References Cited

U.S. PATENT DOCUMENTS

| | | | | | |
|---|---|---|---|---|---|
| 5,242,323 | A * | 9/1993 | Rappaport | F41B 11/642 | 124/66 |
| 5,546,923 | A * | 8/1996 | Duncan | F41B 5/0026 | 124/23.1 |
| 5,570,675 | A * | 11/1996 | Treadway | F41B 5/0026 | 403/306 |
| 6,019,097 | A * | 2/2000 | Cox | F41B 5/0026 | 124/23.1 |
| 6,276,351 | B1 * | 8/2001 | Treadway | F41B 5/0026 | 124/23.1 |
| 9,239,205 | B2 * | 1/2016 | Cummings | F41B 7/08 | |
| 10,928,154 | B1 * | 2/2021 | Kam | F41B 11/646 | |
| 2009/0050128 | A1 * | 2/2009 | Mitchell | F41B 11/646 | 124/66 |
| 2015/0059720 | A1 * | 3/2015 | Barber | F41B 5/0026 | 29/401.1 |
| 2022/0397367 | A1 * | 12/2022 | Mey | F41B 5/0031 | |

* cited by examiner

DEFORMABLE ARCHERY TOY

FIELD OF INVENTION

The invention relates to the field of archery toys, in particular to a deformable archery toy.

BACKGROUND OF THE INVENTION

Archery was originally used in hunting and war. Modern archery started in England, and Scotton Silver Arrow Competition was held in Yorkshire, England since 1673. In 1844, the first All-England Archery Championship was held in England. In 1861, the British Archery Association was established to unify the competition rules. Archery was listed as an official event in the 2nd Olympic Games in 1900, and archery was listed as an event in China in 1956. Archery has the long history and was originally used in hunting and war. The first shooters were hunters, who used bows and arrows to kill animals to survive. Later, bows and arrows became terrible weapons in the war. The ancient Egyptians mastered how to use bows and arrows in 5000 BC. In ancient civilization, bows and arrows were widely used weapons. Many mythical figures, such as Apollo and Odysseus, wear bows and arrows. Modern archery first started in England, and the Scotton Silver Arrow Competition was held in Yorkshire, England since 1673. Rubber-band slingshots can be divided into traditional slingshots and modern slingshots, and their division principle should be completely based on the presence or absence of sight device and wrist rest labor-saving device. For example, wooden slingshots and steel wire slingshots without sight belong to traditional slingshots, while the so-called "traditional bows" with sight formed by wire cutting or casting should be strictly included in the category of modern bows. Because in the whole world, before the development of horizontal grip aiming in China, there was no one person or the product to promote the principle of horizontal grip aiming. The earliest horizontal grip aiming is the king's wind, which initiated the application and promotion of the principle of horizontal grip aiming in slingshot products, and is the originator of the horizontal grip aiming slingshot.

When the traditional archery toys are used, the overall use mode is relatively simple, and they are all designed in one piece, so they can't be folded effectively and the overall structure can't be changed. The overall structure is relatively simple, so the archery toys can't be transformed from archery bows to slingshots, which could not realize the dual-purpose function. With the simple structure, the traditional archery toys cannot meet the needs of different occasions and cannot increase the interest of the whole archery tool. Therefore, a deformable archery toy is needed to solve the problems mentioned above.

SUMMARY OF THE DISCLOSURE

The purpose of the present invention is to provide a deformable archery toy, in order to solve the problems mentioned in the above background, that is, when the traditional archery toys are used, the overall use mode is relatively simple, and they are all designed in one piece, so they can't be folded effectively and the overall structure can't be changed. The overall structure is relatively simple, so the archery toys can't be transformed from archery bows to slingshots, which could not realize the dual-purpose function. With the simple structure, the traditional archery toys cannot meet the needs of different occasions and cannot increase the interest of the whole archery tool.

In one aspect, a deformable archery toy comprises the annular rotating arm, the rotating shaft sleeve, the unfolding arm body A, the unfolding arm body B and the connecting arm body, wherein one end of the annular rotating arm is rotatably connected with the grip connecting arm, the end of the grip connecting arm far away from the annular rotating arm is fixedly connected with the unfolding arm A, the end of the unfolding arm A far away from the grip connecting arm is clamped with the string connecting sleeve A block, the end of the annular rotating arm far away from the grip connecting arm is fixedly connected with the unfolding arm B; the end of the unfolding arm B far away from the grip connecting arm is clamped with the string connection sleeve block B, the connecting string are arranged between the string connection sleeve block A and the string connection sleeve block B, the rotating shaft is sleeved inside the rotating shaft sleeve, the annular hole aiming frame is fixedly connected to the outer wall of the rotating shaft sleeve, the annular hole is arranged inside the annular hole aiming frame; the outer wall of the rotating shaft is fixedly connected with the connecting arm body, and the side of the connecting arm body far away from the rotating shaft is fixedly connected with the holding anti-skid grain, the inner side of the unfolding arm body A is provided with the reinforcing rib A, the outer wall of the unfolding arm body A is provided with the anti-skid grip block A, the outer wall of the unfolding arm body A is embedded with the thickening plate A, the inner side of the unfolding arm body B is provided with the reinforcing rib B, the outer wall of the unfolding arm body B is provided with an anti-skid grip block B, the outer wall of the unfolding arm body B is embedded with the thickening plate B.

As a preferred embodiment of the invention, the aforementioned annular rotating arm includes the rotating shaft sleeve, the annular hole aiming frame and the annular hole; the aforementioned grip connecting arm includes the connecting arm body, the holding anti-skid grain and the rotating shaft.

As a preferred embodiment of the invention, the rotation angle of the annular rotating arm and the grip connecting arm is 0-90°, and the materials of the annular rotating arm, the grip connecting arm, the unfolding arm A, the string connection sleeve block A, the string connection sleeve block B and the unfolding arm B are the same.

As a preferred embodiment of the invention, both the string connection sleeve block A and the string connection sleeve block B are internally provided with connecting string clamps, and the connecting string is wound inside the connecting string clamps; the unfolding arm A, the string connection sleeve block A and the string connection sleeve block B, the unfolding arm B are symmetrically arranged at the two ends of the annular rotating arm and the grip connecting arm.

As a preferred embodiment of the invention, the aforementioned unfolding arm A includes the reinforcing rib A, the thickening plate A, the unfolding arm body A and the anti-skid grip block A.

As a preferred embodiment of the invention, the aforementioned unfolding arm B includes the reinforcing rib B, the thickening plate B, the unfolding arm body B and the anti-skid grip block B.

Compared with the prior art, the present invention is advantageous because it relates to a deformable archery toy could be folded by integrated design, and at the same time, the whole structure could be effectively changed in diversified, which could change the characteristic that the traditional archery toy is relatively simple. The whole archery toy could be changed in diversified, and transformed from the archery bow into the slingshot, which could realize the dual-purpose function, change the characteristics that the traditional archery toy is relatively simple, and meet the needs of different occasions and increase the fun of archery toy.

BRIEF DESCRIPTION OF THE DRAWINGS

Other features, objects and advantages of the present invention will become more apparent through the detailed description of the non-limiting embodiments with reference to the following drawings.

DETAILED DESCRIPTION OF THE PREFERRED EMBODIMENTS

Figure 1:
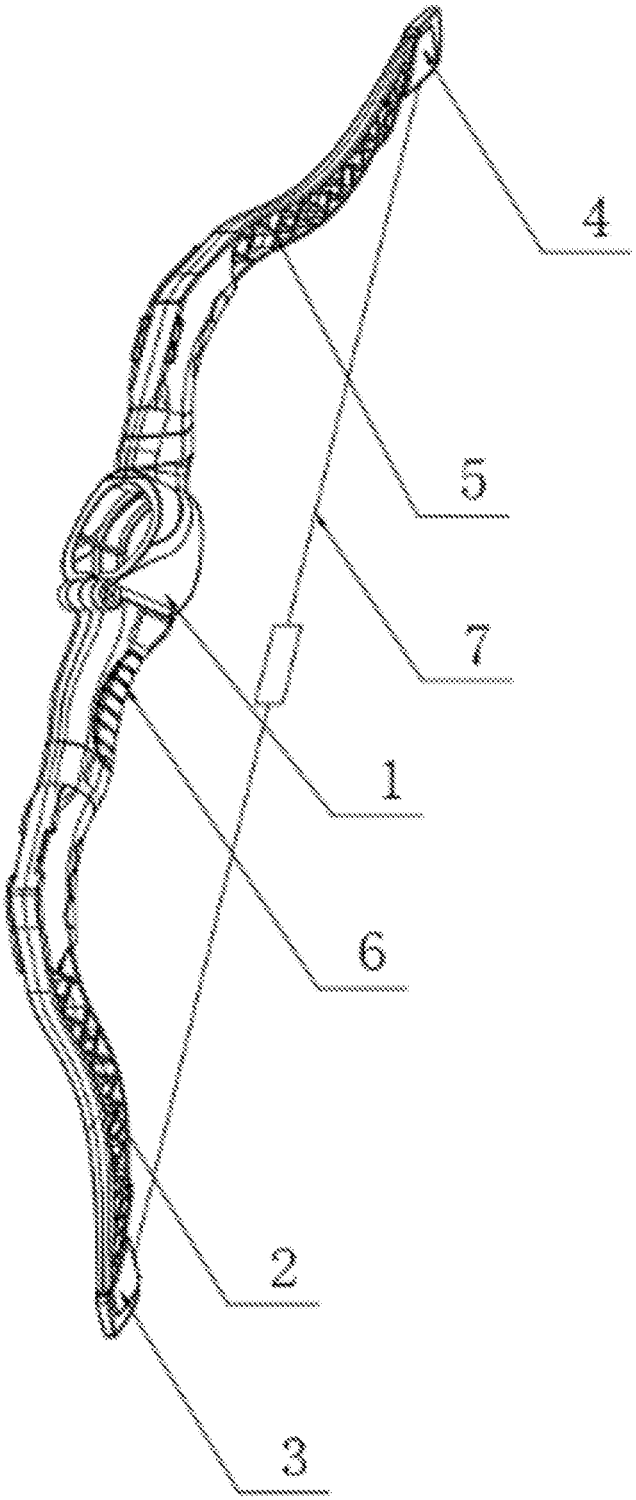
FIG. 1 is the perspective view of the deformable archery toy under the state of archery bow.
Figure 2:
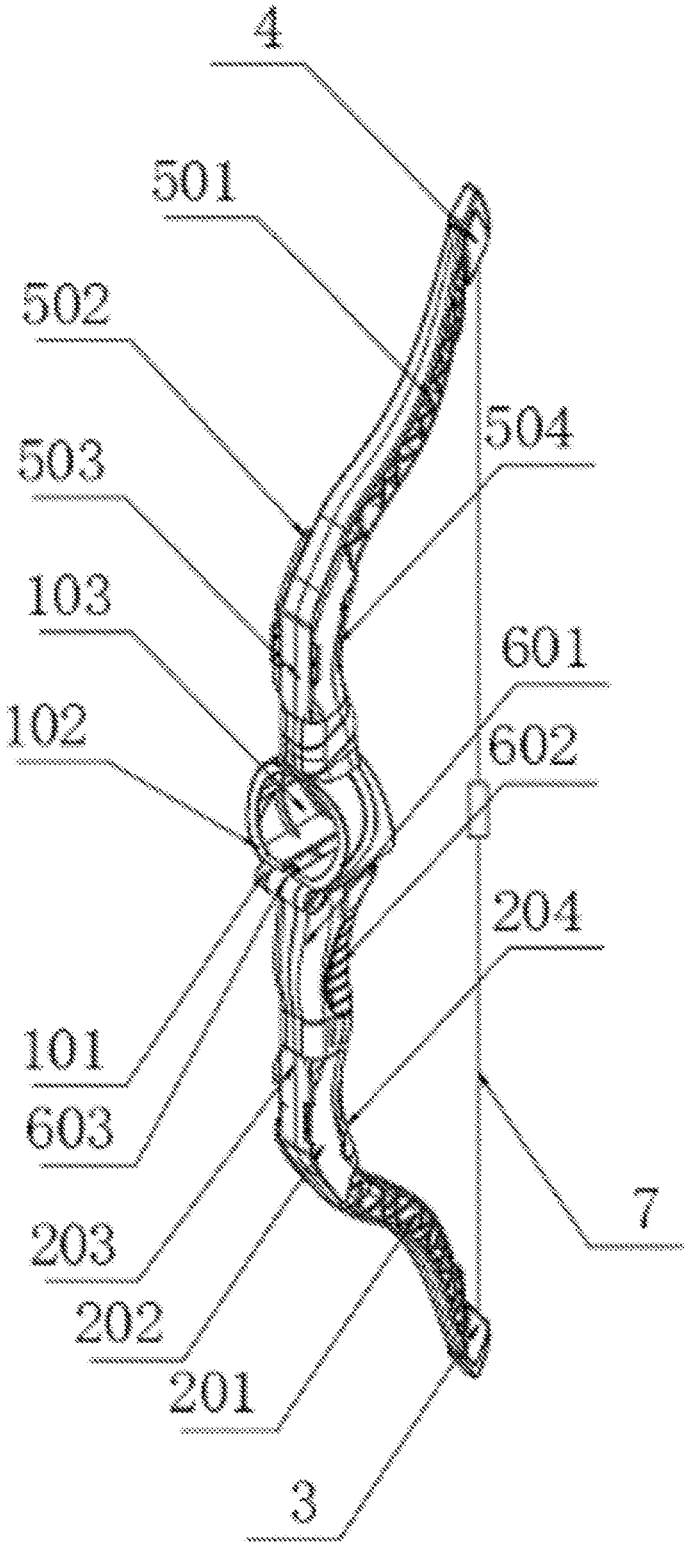
FIG. 2 is the isometric side view of the deformable archery toy under the state of archery bow.

Referring to FIGS. 1 to 4, in one embodiment of the present invention, a deformable archery toy comprises the annular rotating arm 1, the rotating shaft sleeve 101, the unfolding arm body A 203, the unfolding arm body B 503 and the connecting arm body 601, wherein one end of the annular rotating arm 1 is rotatably connected with the grip connecting arm 6, the end of the grip connecting arm 6 far away from the annular rotating arm 1 is fixedly connected with the unfolding arm A 2, the end of the unfolding arm A 2 far away from the grip connecting arm 6 is clamped with the string connecting sleeve A block 3, the end of the annular rotating arm 1 far away from the grip connecting arm 6 is fixedly connected with the unfolding arm B 5, the present invention could be folded by integrated design, and at the same time, the whole structure could be effectively changed, which could change the characteristic that the traditional archery toy is relatively simple in overall use mode when being used. The end of the unfolding arm B 5 in far away from the grip connecting arm 6 is clamped with the string connection sleeve block B 4, the connecting string 7 are arranged between the string connection sleeve block A 3 and the string connection sleeve block B 4, the rotating shaft 603 is sleeved inside the rotating shaft sleeve 101, the annular hole aiming frame 102 is fixedly connected to the outer wall of the rotating shaft sleeve 101, the annular hole 103 is arranged inside the annular hole aiming frame 102. During use, when the folding angle between the annular rotating arm 1 and the grip connecting arm 6 is 0°, the archery bow structure is formed, and then they are sleeved at both ends of the unfolding arm A 2 and the unfolding arm B 5 under the action of the string connection sleeve block A 3 and the string connection sleeve block B 4, then the connecting string 7 is connected, and then the connecting string 7 is tightened under the action of the connecting string clamps inside the string connection sleeve block A 3 and the string connection sleeve block B 4; Arrows are placed and sent through the annular hole aiming frame 102 and the annular hole 103, and then the archery operation of the archery bow is completed under the cooperation of the connecting string 7 with the integral structure of the annular rotating arm 1, the grip connecting arm 6, the unfolding arm A 2, the string connection sleeve block A 3, the string connection sleeve block B 4 and the unfolding arm B 5. The outer wall of the rotating shaft 603 is fixedly connected with the connecting arm body 601, and the side of the connecting arm body 601 far away from the rotating shaft 603 is fixedly connected with the holding anti-skid grain 602, the inner side of the unfolding arm body A 203 is provided with the reinforcing rib A 201, the outer wall of the unfolding arm body A 203 is provided with the anti-skid grip block A 204, the outer wall of the unfolding arm body A 203 is embedded with the thickening plate A 202, the inner side of the unfolding arm body B 503 is provided with the reinforcing rib B 501, the outer wall of the unfolding arm body B 503 is provided with an anti-skid grip block B 504, the outer wall of the unfolding arm body B 503 is embedded with the thickening plate B 502.

Figure 3:
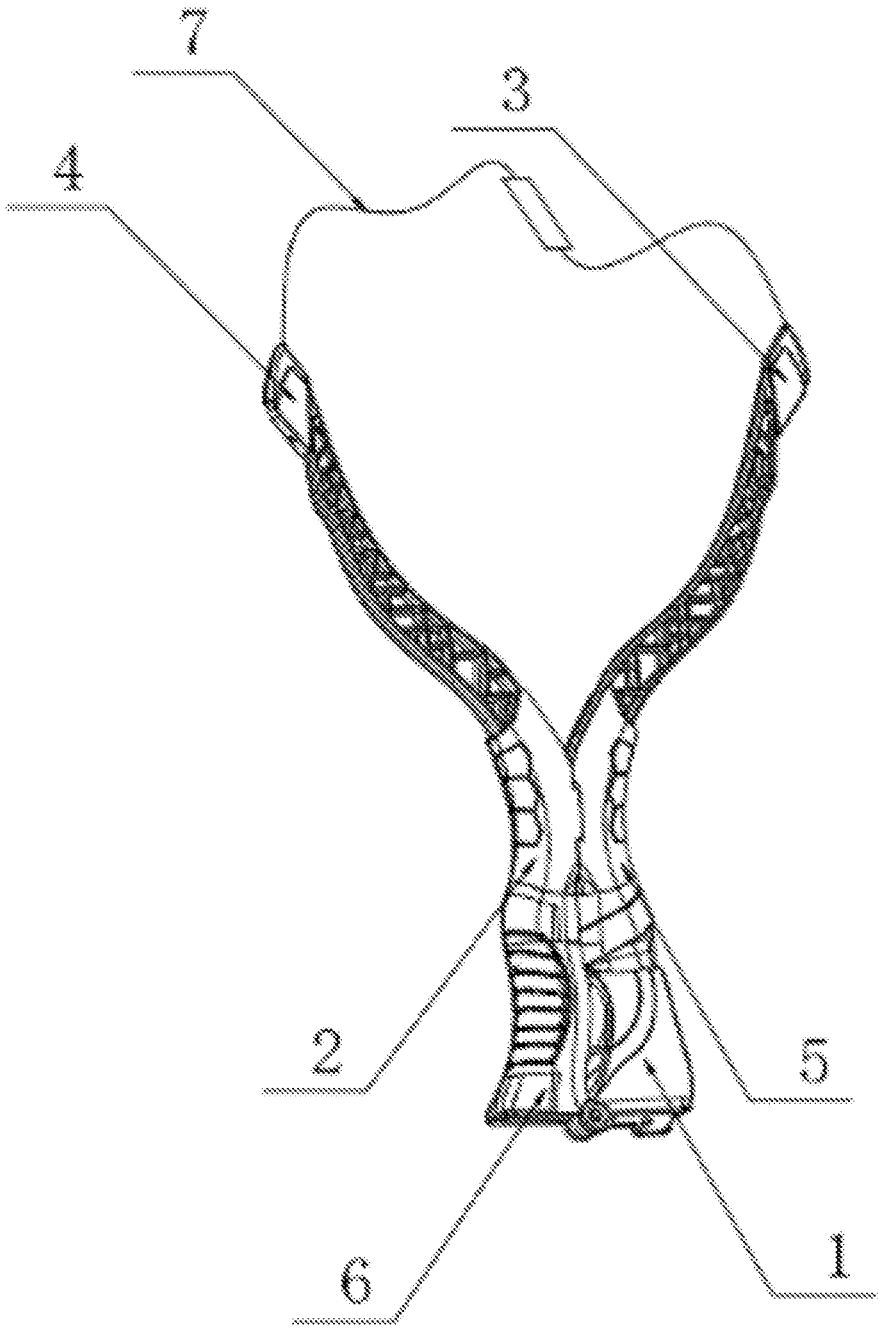
FIG. 3 is the perspective view of the deformable archery toy under the state of slingshot.
Figure 4:
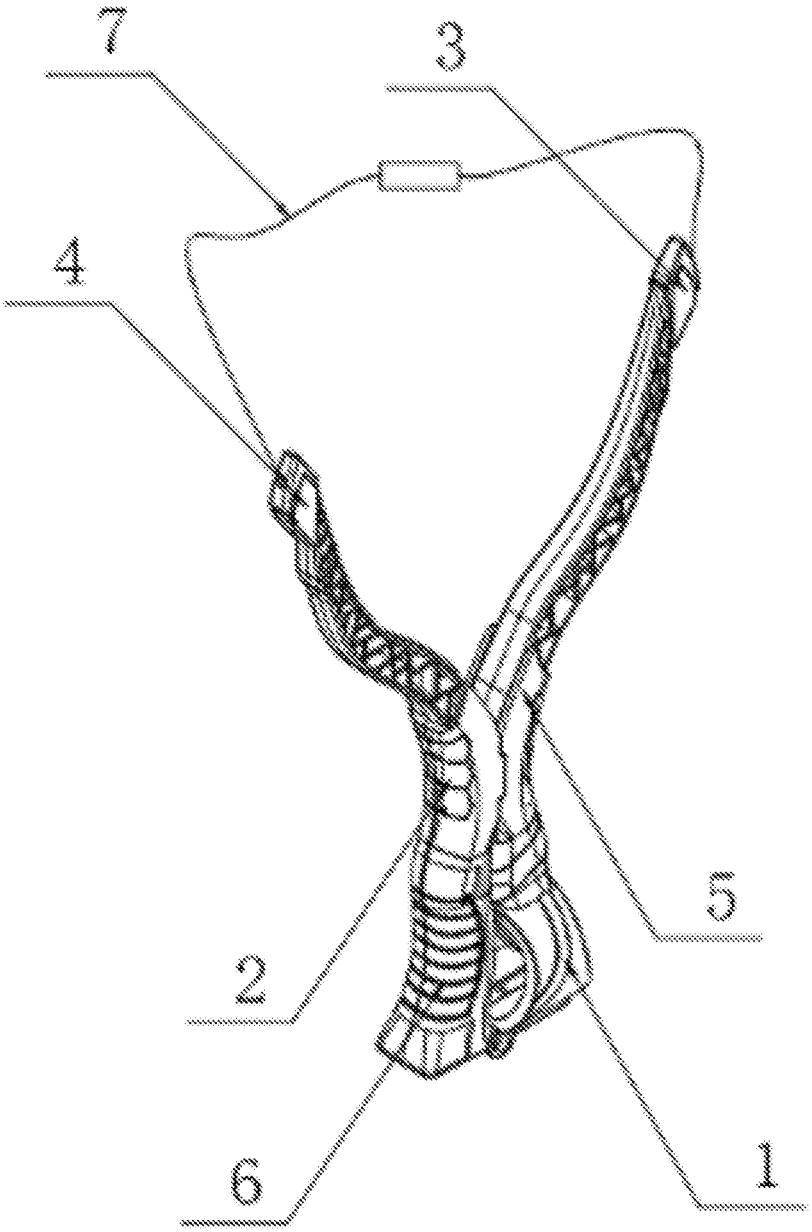
FIG. 4 is the isometric side view of the deformable archery toy under the state of slingshot.

Referring to FIGS. 1 and 3, the annular rotating arm 1 includes the rotating shaft sleeve 101, the annular hole aiming frame 102 and the annular hole 103; the grip connecting arm 6 includes the connecting arm body 601, the holding anti-skid grain 602 and the rotating shaft 603. The rotation angle of the annular rotating arm 1 and the grip connecting arm 6 is 0-90°, and the materials of the annular rotating arm 1, the grip connecting arm 6, the unfolding arm A 2, the string connection sleeve block A 3, the string connection sleeve block B 4 and the unfolding arm B 5 are the same. When the folding angle between the annular rotating arm 1 and the grip connecting arm 6 is 90°, the unfolding arm A 2, the string connection sleeve block A 3 and the string connection sleeve block B 4, the unfolding arm B 5 are symmetrically arranged, in order to realize that the connecting string 7 is in the loose state; the annular rotating arm 1 and the grip connecting arm 6 are mainly used for hand holding, and then the certain space is formed between the annular rotating arm 1 and the grip connecting arm 6, the the bracket is formed, so that glass beads and stones could be placed in the middle position of the connecting string 7, then by pulling the connecting string 7 to the maximum elastic position, and using the space between the annular rotating arm 1 and the grip connecting arm 6 to realize the operation of ejecting, in this way, the function of the slingshot could be realized. Both the string connection sleeve block A 3 and the string connection sleeve block B 4 are internally provided with connecting string clamps, and the connecting string 7 is wound inside the connecting string clamps; the unfolding arm A 2, the string connection sleeve block A 3 and the string connection sleeve block B 4, the unfolding arm B 5 are symmetrically arranged at the two ends of the annular rotating arm 1 and the grip connecting arm 6. The unfolding arm A 2 includes the reinforcing rib A 201, the thickening plate A 202, the unfolding arm body A 203 and the anti-skid grip block A 204. The whole structure could be effectively changed in diversified, the whole archery toy could be folded, and the archery toy could be transformed from the archery bow into the slingshot, which could realize the dual-purpose function, change the characteristics that the traditional archery toy is relatively simple, and meet the needs of different occasions and increase the fun of archery toy. The unfolding arm B 5 includes the reinforcing rib B 501, the thickening plate B 502, the unfolding arm body B 503 and the anti-skid grip block B 504.

It should be noted that the invention is a deformable archery toy, which comprises: 1. Annular rotating arm; 101. Rotating shaft sleeve; 102. Annular hole aiming frame; 103. Annular hole; 2. Unfolding arm A; 201. Reinforcing rib A;

202. Thickening plate A; 203. Unfolding arm body A; 204. Anti-skid grip block A; 3. String connection sleeve block A; 4. String connection sleeve block B; 5. Unfolding arm B; 501. Reinforcing rib B; 502. Thickening plate B; 503. Unfolding arm body B; 504. Anti-skid grip block B; 6. Grip connecting arm; 601. Connecting arm body; 602. Holding anti-skid grain; 603. Rotating shaft; 7. Connecting string. The components are all common standard parts or components known to those skilled in this field, and their structures and principles could be known to those skilled in this field through technical manuals or conventional experimental methods.

The working principle of the invention is as follows: the deformable archery toy could be folded by integrated design, and at the same time, the whole structure could be effectively changed in diversified, which could change the characteristic that the traditional archery toy is relatively simple. During use, when the folding angle between the annular rotating arm 1 and the grip connecting arm 6 is 0°, the archery bow structure is formed, and then they are sleeved at both ends of the unfolding arm A 2 and the unfolding arm B 5 under the action of the string connection sleeve block A 3 and the string connection sleeve block B 4, then the connecting string 7 is connected, and then the connecting string 7 is tightened under the action of the connecting string clamps inside the string connection sleeve block A 3 and the string connection sleeve block B 4; Arrows are placed and sent through the annular hole aiming frame 102 and the annular hole 103, and then the archery operation of the archery bow is completed under the cooperation of the connecting string 7 with the integral structure of the annular rotating arm 1, the grip connecting arm 6, the unfolding arm A 2, the string connection sleeve block A 3, the string connection sleeve block B 4 and the unfolding arm B 5. When the folding angle between the annular rotating arm 1 and the grip connecting arm 6 is 90°, the unfolding arm A 2, the string connection sleeve block A 3 and the string connection sleeve block B 4, the unfolding arm B 5 are symmetrically arranged, in order to realize that the connecting string 7 is in the loose state;

the annular rotating arm 1 and the grip connecting arm 6 are mainly used for hand holding, and then the certain space is formed between the annular rotating arm 1 and the grip connecting arm 6, the the bracket is formed, so that glass beads and stones could be placed in the middle position of the connecting string 7, then by pulling the connecting string 7 to the maximum elastic position, and using the space between the annular rotating arm 1 and the grip connecting arm 6 to realize the operation of ejecting, in this way, the function of the slingshot could be realized. The whole structure could be effectively changed in diversified, the whole archery toy could be folded, and the archery toy could be transformed from the archery bow into the slingshot, which could realize the dual-purpose function, change the characteristics that the traditional archery toy is relatively simple, and meet the needs of different occasions and increase the fun of archery toy.

Hereinafter, embodiments of the present invention has been described in detail with reference to the accompanying drawings. While the description above refers to the particular embodiments of the present invention, it will be understood that many modifications may be made without departing from the spirit thereof. Any equivalent replacement or modification would fall within the protection scope of the present invention.

What is claimed is:

1. A deformable archery toy comprises an annular rotating arm (1), a rotating shaft sleeve (101), an unfolding arm body A (203), an unfolding arm body B (503) and a connecting arm body (601), wherein one end of the annular rotating arm (1) is rotatably connected with a grip connecting arm (6), an end of the grip connecting arm (6) far away from the annular rotating arm (1) is fixedly connected with an unfolding arm A (2), one end of the unfolding arm A (2) far away from the grip connecting arm (6) is clamped with a string connecting sleeve A block (3), an end of the annular rotating arm (1) far away from the grip connecting arm (6) is fixedly connected with an unfolding arm B (5); one end of the unfolding arm B (5) far away from the grip connecting arm (6) is clamped with a string connection sleeve block B (4), a connecting string (7) is arranged between the string connection sleeve block A (3) and the string connection sleeve block B (4); a rotating shaft (603) is sleeved inside a rotating shaft sleeve (101), and an annular hole aiming frame (102) is fixedly connected to an outer wall of the rotating shaft sleeve (101); an annular hole (103) is arranged inside an annular hole aiming frame (102); an outer wall of the rotating shaft (603) is fixedly connected with the connecting arm body (601), and a side of the connecting arm body (601) far away from the rotating shaft (603) is fixedly connected with a holding anti-skid grain (602), an inner side of an unfolding arm body A (203) is provided with a reinforcing rib A (201), an outer wall of the unfolding arm body A (203) is provided with an anti-skid grip block A (204), the outer wall of the unfolding arm body A (203) is embedded with a thickening plate A (202); an inner side of an unfolding arm body B (503) is provided with a reinforcing rib B (501), an outer wall of the unfolding arm body B (503) is provided with an anti-skid grip block B (504), the outer wall of the unfolding arm body B (503) is embedded with a thickening plate B (502).

2. A deformable archery toy according to claim 1, wherein the annular rotating arm (1) includes the rotating shaft sleeve (101), the annular hole aiming frame (102) and the annular hole (103); the grip connecting arm (6) includes the connecting arm body (601), the holding anti-skid grain (602) and the rotating shaft (603).

3. A deformable archery toy according to claim 1, wherein a rotation angle of the annular rotating arm (1) and the grip connecting arm (6) is 0-90°, and materials of the annular rotating arm (1), the grip connecting arm (6), the unfolding arm A (2), the string connection sleeve block A (3), the string connection sleeve block B (4) and the unfolding arm B (5) are identical.

4. A deformable archery toy according to claim 1, wherein both the string connection sleeve block A (3) and the string connection sleeve block B (4) are internally provided with connecting string clamps, and the connecting string (7) is wound inside the connecting string clamps; the unfolding arm A (2), the string connection sleeve block A (3) and the string connection sleeve block B (4).

5. A deformable archery toy according to claim 1, wherein the unfolding arm A (2) includes the reinforcing rib A (201), the thickening plate A (202), the unfolding arm body A (203) and the anti-skid grip block A (204).

6. A deformable archery toy according to claim 1, wherein the unfolding arm B (5) includes the reinforcing rib B (501), the thickening plate B (502), the unfolding arm body B (503) and the anti-skid grip block B (504).

* * * * *